United States Patent [19]

Brown

[11] Patent Number: 4,813,158

[45] Date of Patent: Mar. 21, 1989

[54] ATHLETIC SHOE WITH MESH REINFORCEMENT

[75] Inventor: Paul D. Brown, Hingham, Mass.

[73] Assignee: Reebok International Ltd., Canton, Mass.

[21] Appl. No.: 11,593

[22] Filed: Feb. 6, 1987

[51] Int. Cl.[4] ..... A43B 5/00; A43B 11/00

[52] U.S. Cl. ..... 36/114; 36/45; 36/50

[58] Field of Search ..... 36/93, 45, 114, 88, 36/58.5, 50, 3 A, 91

[56] References Cited

U.S. PATENT DOCUMENTS

| | | | |
|---|---|---|---|
| D. 293,847 | 1/1988 | Le et al. . | |
| D. 297,182 | 8/1988 | Brown et al. . | |
| 3,768,182 | 10/1973 | Powers | 36/114 |
| 4,222,183 | 9/1980 | Haddox | 36/114 |
| 4,232,458 | 11/1980 | Bartels | 36/45 |
| 4,236,328 | 12/1980 | Friedlander | 36/58.5 |
| 4,245,408 | 1/1981 | Larsen et al. | 36/50 |
| 4,255,876 | 3/1981 | Johnson | 36/83 |
| 4,413,431 | 11/1983 | Cavanagh | 36/114 |
| 4,447,967 | 5/1984 | Zaino | 36/45 |
| 4,616,432 | 10/1986 | Bunch et al. | 36/114 |
| 4,622,763 | 11/1986 | Adams | 36/50 |
| 4,670,998 | 6/1987 | Pasternar | 36/114 |

FOREIGN PATENT DOCUMENTS

| | | | |
|---|---|---|---|
| 0109385 | 5/1984 | European Pat. Off. . | |
| 1258562 | 3/1961 | France | 36/114 |
| 1272888 | 8/1961 | France | 36/45 |
| 2586905 | 3/1987 | France | 36/58.5 |
| 1081068 | 8/1967 | United Kingdom | 36/45 |

OTHER PUBLICATIONS

Pro-Joggs, Footwear News Magazine, Apr. 1984, p. 45.

*Primary Examiner*—Steven N. Meyers

*Attorney, Agent, or Firm*—Saidman, Sterne, Kessler & Goldstein

[57] ABSTRACT

A lightweight athletic shoe includes reinforcing members which provide added strength and lateral support without detracting from breathability, comfort or flexibility. The reinforcing members extend upwardly from between the sole and the upper or opposite sides of the shoe to the forward portion of the lacing opening and comprise a thin, nonstretchable material. The reinforcing members are preferably fabricated as a strip with an interior region having openings and an edge region for stitching the strip to the upper of the shoe. A cross member can extend between and join the reinforcing members to define a unitary locking element. The reinforcing members and the cross member are located at least slightly behind the a line between the first metatarsal head and the fifth metatarsal head of the foot or flexing line of the shoe. An alternate embodiment provides a single lateral side reinforcing member.

17 Claims, 6 Drawing Sheets

ATHLETIC SHOE WITH MESH REINFORCEMENT

FIELD OF THE INVENTION

This invention relates to the construction of lightweight athletic shoes and, more particularly, to athletic shoes with one or more reinforcing members which provide added strength and lateral support without detracting from breathability, comfort or flexibility.

BACKGROUND OF THE INVENTION

Each time of the shoe of a runner contacts the ground, considerable force is transmitted through the shoe to the runner's foot. This force tends to push the foot forward in the shoe, causing discomfort. In addition, lateral forces cause relative lateral movement between the foot and the shoe. These lateral forces not only produce fatigue in the runner's foot, but also tend to stretch and wear the shoe, particularly in the metatarsal region. Also, the lateral forces can offset the upper part of the shoe from the sole such that the runner's foot is not properly aligned over the sole.

It is known in the prior art to provide lateral and medial reinforcing straps which extend from the lasting margin to the lacing margin. U.S. Pat. No. 4,413,431 discloses a shoe with a one-piece reinforcement which extends about the lacing opening and has lateral reinforcing portions. Athletic shoes having lateral reinforcing strips have also been shown in U.S. Pat. Nos. 4,245,408, 4,255,876 and 4,447,967. U.S. Pat. No. 4,255,876 also discloses the use of a mesh fabric for protecting the toe region of an athletic shoe. The prior art shoe constructions have certain disadvantages such as a tendency for the reinforcing straps to stretch during use, inability to withstand prolonged wear and lack of wearer comfort. The prior art reinforcing straps reduce the flexibility and breathability of the shoe since an imperforate layer of reinforcing material is added to the shoe.

It is desired to provide an athletic shoe with one or more reinforcing members which provide a high degree of support on the side of the foot and which, at the same time, have long life and do not stretch during use. Further, and importantly, it is desired that the reinforcing members maintain the breathability of the athletic shoe so that moisture and heat are not retained within the shoe during use. In addition, the reinforcing members must have flexibility so that they do not restrict or cause discomfort to the wearer during vigorous and prolonged use. A further requirement of the reinforcing members is that they protect against external scuffing and wear which may come from a variety of sources such as, for example, friction against a floor during a squash game.

It is a general object of the present invention to provide an improved athletic shoe.

It is a further object of the present invention to provide an athletic shoe having one or more reinforcing members to prevent lateral foot movement without reducing the breathability of the shoe.

It is a further object of the present invention to provide an athletic shoe with one or more reinforcing members to prevent lateral foot movement without detracting from the comfort and flexibility of the shoe.

It is yet another object of the present invention to provide an athletic shoe having improved foot stability and comfort.

SUMMARY OF THE INVENTION

According to the present invention, these and other objects and advantages are achieved in a lightweight athletic shoe comprising an upper and a sole, the upper including a top made of a light, flexible and breathable material, a U-shaped fastener margin stitched to the top and defining a fastener opening for the upper, and at least one reinforcing member extending upwardly from between the sole and the upper to the forward portion of the fastener opening and the reinforcing member is secured to the fastener margin. Each reinforcing member is postioned rearwardly of the flexing line of the shoe which is defined by a line between the first metatarsal head and the fifth metatarsal head. The reinforcing member comprises a thin, nonstretchable material with a plurality of openings, whereby the reinforcing member reinforces the upper and laterally stabilizes the foot of the wearer while providing a shoe with breathability and flexibility.

Preferably, the reinforcing member is made with an interior region having openings for breathability and flexibility distributed over its surface and an edge region for stitching the reinforcing member to the upper. It is preferred that the openings have rounded corners to reduce splitting which otherwise would occur at sharp corners. The shape of the openings can be generally square, oval, circular or rectangular. The reinforcing members are preferably about 50% open to insude breathability and flexibility and can be made of polyurethane, a polyester elastomer, polyether, nylon or a polyester elastomer.

In the preferred embodiment, lateral and medial reinforcing members extend upwardly from between the sole and upper on opposite sides of the shoe to the forward portion of the lacing margin. The reinforcing members extend across at least one lacing hole and are drawn together and tightened by the lace of the shoe. The lace of the shoe provides a combined locking and reinforcing member that extends upwardly from the sole on either side of the shoe to greatly strengthen the shoe thus increasing the function of the lace to a lateral support and reinforcement as well as a tie arrangement. While laces are preferred, some additional reinforcement can also be obtained from the use of Velcro or other closures in conjunction with the reinforcing members of this invention.

In another preferred embodiment, a cross member extends between and joins the lateral and medial reinforcing members at the forward end of the lacing opening to form a unitary locking element for the forward part of the shoe. The reinforcing members and the cross member can have a forward edge angled to match the flexing line of the shoe.

In yet another preferred embodiment, a single reinforcing member with elongated, rectangular openings is provided on the lateral side of an athletic shoe. The openings extend upwardly from the sole toward the lacing margin and define parallel strips.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figures 1, 1A:
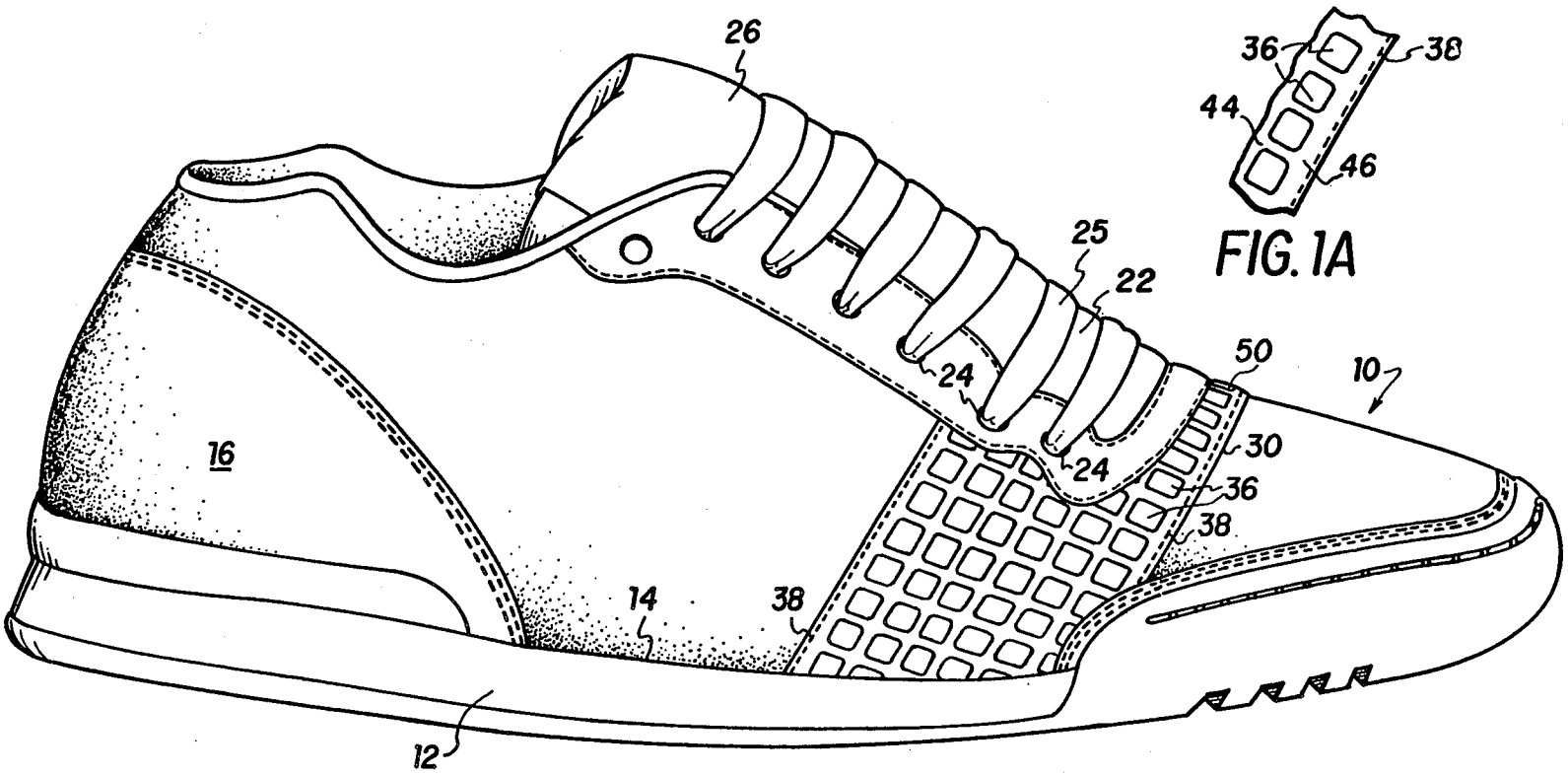
FIG. 1 is a right side view of an athletic shoe in accordance with the present invention.
FIG. 1A is an enlarged fragmentary view of a reinforcing member.
Figure 2:
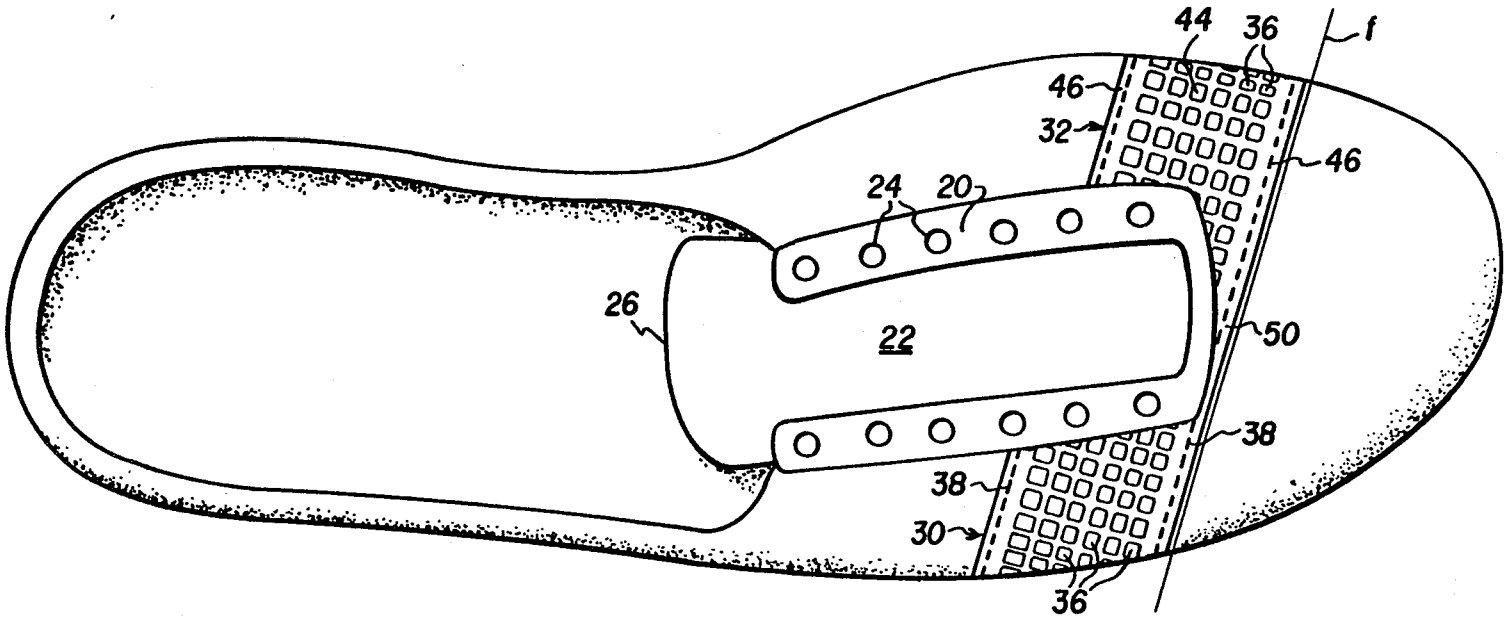
FIG. 2 is a top view of an athletic shoe in accordance with the present invention.
Figure 3:
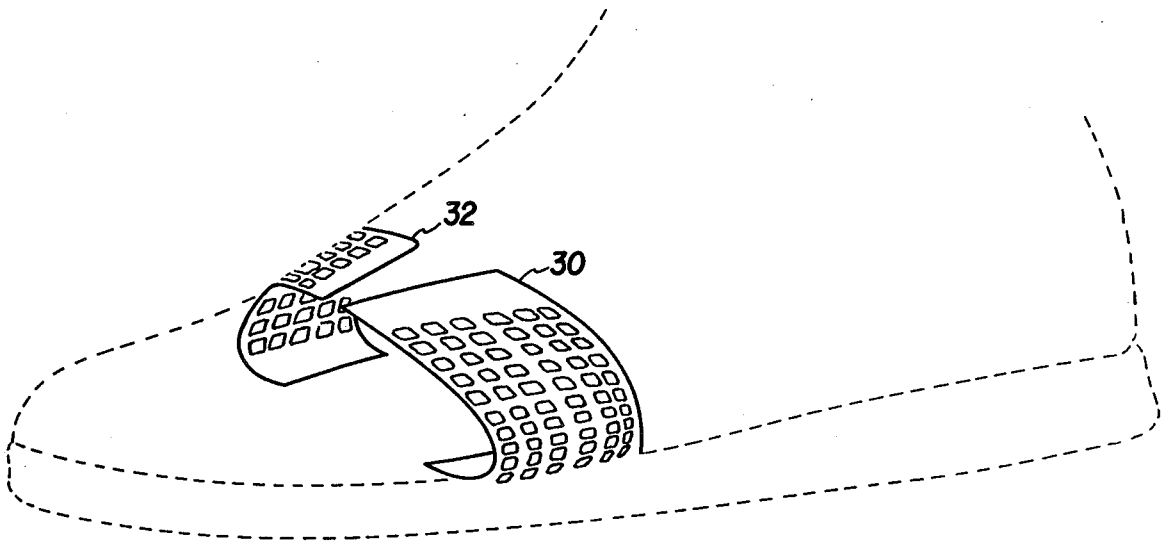
FIG. 3 is a schematic illustration of the reinforcing members of the present invention with the remainder of the athletic shoe shown in phantom.

A laced, lightweight athletic shoe in accordance with the present invention is shown in FIGS. 1 and 2. An upper 10 is joined to a sole 12 at a lasting margin 14. A top 16, or vamp, of a light, flexible and breathable material extends from the rear of the heel along the sides and covers the toe portion. A U-shaped lacing margin 20 is stiched to the top 16 and defines a lacing opening 22. The lacing margin 20 is provided with a plurality of lacing holes 24 for a lace 25. A tongue 26 underlies the lacing margin 20 and the lacing opening 22. A lateral reinforcing member 320 and a medial reinforcing member 32 extend upwardly from opposite sides of the lasting margin 14, which as known in the art is the abutting surfaces of the sole and upper over the top 16 to the lacing opening 22 adjacent the forward portion thereof and overlying or underlying and secured to the lacing margin 20. The present invention can also be utilized in a shoe with hook and loop type fasteners, such as Velcro fasteners.

In accordance with the present invention, each of the reinforcing members 30 and 32 by its construction and location acts as a forefoot stabilizer and substantially strengthens and reinforces the shoe without detracting from its breathbility, flexibility or comfort. Each of the reinforcing members 30, 32 is fabricated of a thin sheet of substantially nonstretchable material such as polyurethane, a polyether elastomer such as PeBax, polyether, nylon, a polyester elastomer such as Hytrel or other organic polymeric material having good strength properties. A plurality of openings 36 in the material provide breathability and substantially increase the flexbility relative to a solid sheet of material. In a preferred embodiment of the invention material of the reinforcing members 30, 32 is, in effect, a mesh with a relatively large open area. To provide the desired strength without compromising flexibility, it is preferable that the reinforcing members 30, 32 be made of a flexible but relatively incompressible material. The material of the reinforcing members 30, 32 is preferably in the range between 1.0 and 1.5 mm in thickness to provide the necessary strength while permitting the material to be stitched with conventional shoe-making machinery. In some cases the thickness can vary depending on the particular material used.

The reinforcing members 30, 32 extend into the sole 12 between a midsole and an insole and are securely fastened with an adhesive. They can be mounted in a conventional lasting operation. They are stitched 38 as indicated by reference character to the upper 10 along each edge and, in one preferred embodiment, may extend across at least one lacing hole 24. The portion of each reinforcing member 30, 32 which extends across one of the lacing holes 24 has a hole aligned with the respective lacing hole 24. Thus, the lace 25 passes through the reinforcing members 30, 32 and draws them together and tightens them. When Velcro fasteners are used, the reinforcing members 30, 33 extend to and are secured to a fastener margin on either side of a fastener opening. The fastener margin is similar to the lacing margin 20.

The reinforcing members 30, 32 are located at lest slightly to the rear of the flexing line of the shoe as shown in in FIG. 2 the reinforcing members 30, 32 are and preferably angled to correspond with the natural flex angle of the forefoot as defined by a line drawn from the first metatarsal head to the fifth metatarsal head. The reinforcing members 30, 32 can be positioned further to the rear if so desired.

It is preferred that the reinforcing members 30, 32 have openings without sharp corners. The openings 36 shows in FIG. 1A have rounded corners which provide a substantial amount of material between openings 36 for strength and to avoid sharp corners that have a tendency to split during prolonged use. Square or rectangular openings can also be utilized but have a tendency to split at the corners during prolonged use. Preferably, the material of the reinforcing members 30, 32 has about 50% open area. The reinforcing members 30, 32 can be fabricated with interior regions 44 having regular spaced openings and solid edge regions 46 of sufficient width to facilitate stitching.

In another embodiment of the present invention, a cross member 50 can extend between and join reinforcing members 30, 32 forward of the lacing opening 22. The cross member 50 and the reinforcing members 30, 32 can be fabricated as an integral, unitary strip so that these members form a single locking and reinforcing element for the shoe. In a preferred embodiment, the reinforcing members 30, 32 and the cross member 50 are cut from a single strip of material and are stitched to the shoe at the angle described hereinabove.

Figure 4:
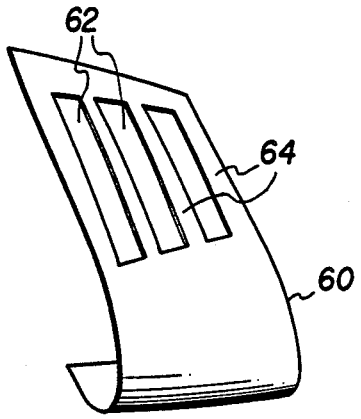
FIG. 4 is a schematic illustration of another embodiment of a reinforcing member in accordance with the present invention.
Figure 5:
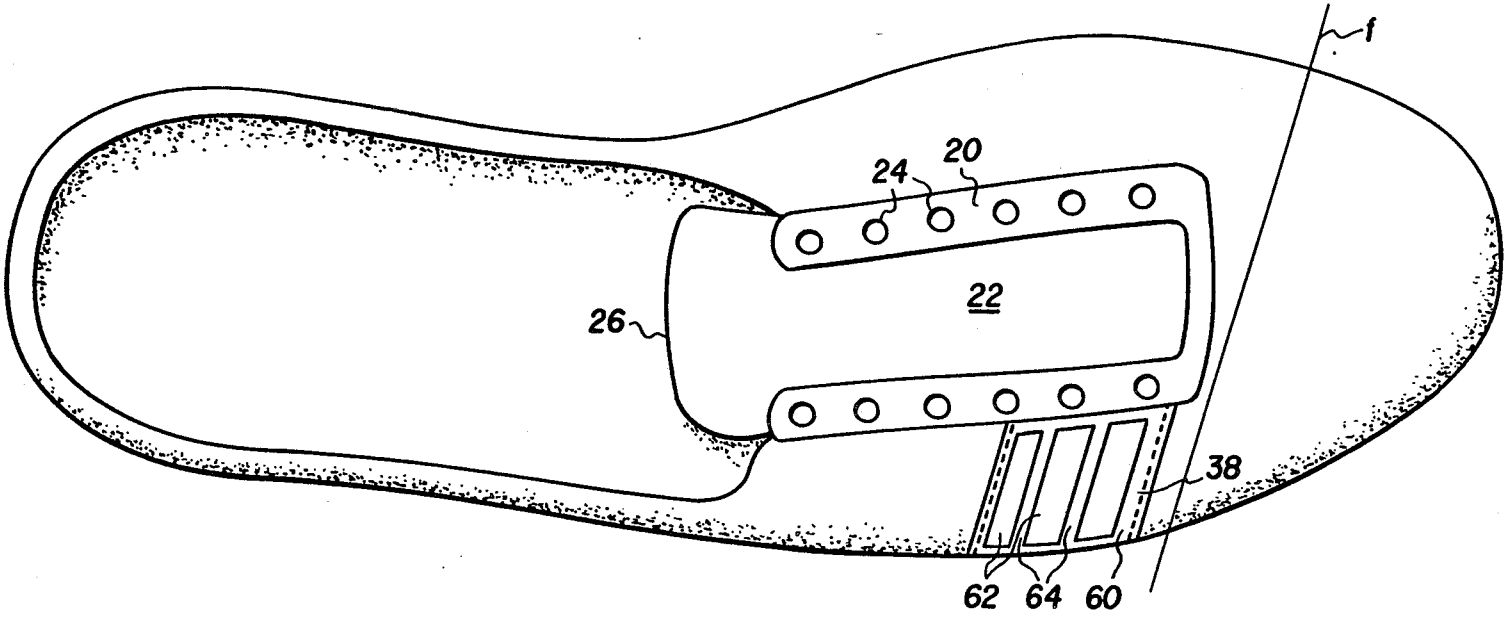
FIG. 5 is a top view of another embodiment of an athletic shoe in accordance with the invention.
Figure 6:
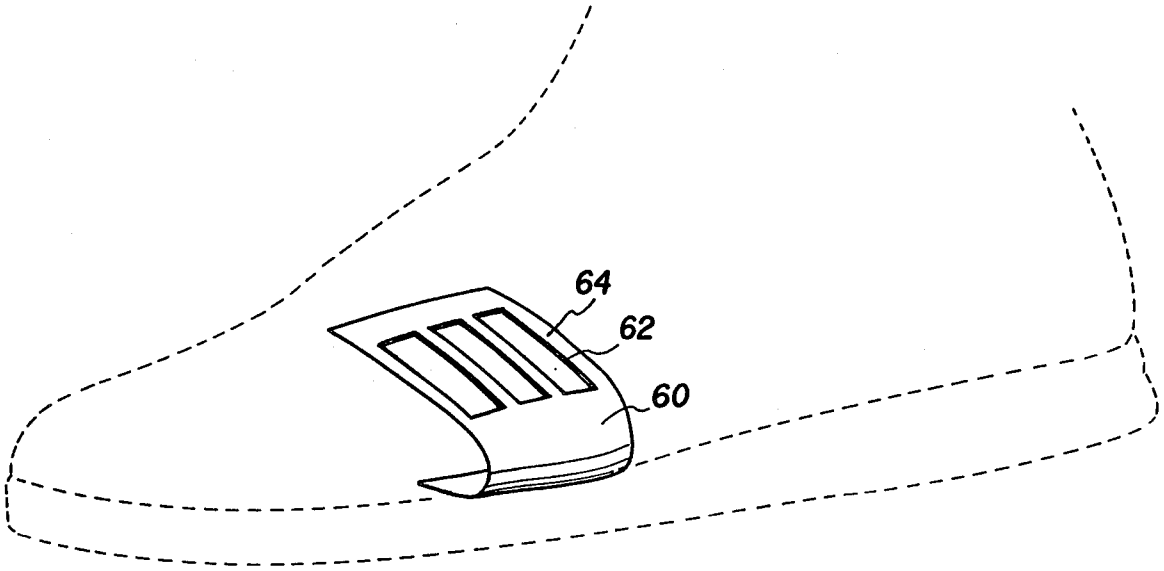
FIG. 6 is a schematic illustration of the reinforcing members of the present invention with the remainder of the athletic shoe shown in phantom.

Another embodiment of the present invention is shown in FIGS. 4–6, which illustrate a single reinforcing member 60. The reinforcing member 60 extends upwardly from the lasting margin 14 between sole 12 and upper 10 of the shoe on the lateral side and is secured to the forward portion of the lacing margin. A plurality of elongated, parallel rectangular openings 62 define strips 64 upwardly along the reinforcing member 60. In a preferred embodiment, the rectangular openings 62 are 5.0 mm in width and the strips 64 are 4.0 mm in width. The reinforcing member 60 provides the advantages of breathability and flexibility. A second reinforcing member having rectangular openings can be utilized on the medial side for further reinforcement, if desired, and the lateral and medial reinforcing members may be integrally formed as previously noted with respect to the mesh reinforcement embodiment of the present invention.

In accordance with the present invention, reinforcing members can be used on the lateral side or on both sides depending on where the stress is likely to be concentrated in a particular activity. For example, in aerobics stress is likely to be greatest on the lateral side. An added benefit of the reinforcing members 30, 32, 60 is that they protect the areas which they cover against scuffing, abrasion and other forms of wear. In squash, for example, scuffing and abrasion are likely to occur on the medial side. The reinforcing members of the present invention can be partially or fully covered by one or more layers of the shoe upper, if desired.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A lightweight athletic shoe comprising:

an upper and a sole, said upper including a top made of light, flexible and breathable material;

a U-shaped lacing margin stitched to the top and defining a lacing opening for the upper;

lacing holes disposed on each side of the lacing opening in the lacing margin; and lateral and medial reinforcing members extending upwardly from between the sole and the upper on opposite sides of the shoe to the forward portion of the lacing opening and secured to the lacing margin, said reinforcing members each extending across at least one lacing hole and having a hole therethrough aligned with the lacing hole across which the reinforcing member extends, each reinforcing member being positioned rearwardly of a flexing line of the shoe and comprising a thin, nonstretchable material with a plurality of openings;

whereby said reinforcing members are drawn together and tightened by the lace of said shoe and reinforce the upper and laterally stabilize the foot of the wearer while providing the shoe with breathability and flexibility.

2. A lightweight athletic shoe comprising:

an upper and sole, said upper including a top made of light, flexible and breathable material;

a U-shaped lacing margin stitched to the top and defining a lacing opening for the upper;

lateral and medial reinforcing members extending upwardly from between the sole and the upper on opposite sides of the shoe to the forward portion of the lacing opening and secured to the lacing margin, each reinforcing member being positioned rearwardly of a flexing line of the shoe and comprising a thin, nonstretchable material with a plurality of openings; and a cross member extending between and joining said reinforcing members at the forward end of said lacing opening;

whereby said reinforcing members reinforce the upper and laterally stabilize the foot of the wearer while providing the shoe with breathability and flexibility.

3. An athletic shoe as defined in claim 2 wherein said reinforcing members and said cross member together form a unitary locking element for the forward portion of said shoe.

4. An athletic shoe as defined in claim 2 wherein said reinforcing members and said cross member have a forward edge substantially parallel to, and disposed slightly to the rear of the flexing line of said shoe.

5. A lightweight athletic shoe comprising:

an upper and a sole, said upper including a top made of light, flexible and breathable material;

a U-shaped lacing margin stitched to the top and defining a lacing opening for the upper; and lateral and medial reinforcing members extending upwardly from between the sole and the upper on opposite sides of the shoe to the forward portion of the lacing opening and secured to the lacing margin, each reinforcing member being positioned rearwardly of a flexing line of the shoe and comprising a thin, nonstretchable material with an interior region having a plurality of regularly spaced openings and solid edge regions for stitching;

whereby said reinforcing members reinforce the upper and laterally stabilize the foot of the wearer while providig the shoe with breathability and flexibility.

6. A lightweight athletic shoe comprising:

an upper and a sole, said upper including a top made of a light, flexible and breathable material;

a U-shaped lacing margin stitched to the top and defining a lacig opening for the upper;

lacing holes disposed on each side of the lacing opening in the lacing margin; and a lateral reinforcing member extending upwardly on the lateral side of the shoe from between the sole and the upper to the forward portion of the lacing opening and secured to the lacing margin, said reinforcing member extending across at least one lacing hole and having a hole therethrough aligned with the lacing hole across which the reinforcing member extends, said reinforcing member being positioned rearwardly of a flexing line of the shoe and comprising a thin, nonstretchable material with a plurality of openings;

whereby said reinforcing member reinforces the upper and laterally stabilize the foot of the wearer while providing the shoe with breathability and flexibility.

7. A light weight athletic shoe comprising:

an upper and a sole, said upper including a top made of a light, flexible and breathable material;

a U-shaped lacing margin stitched to the top and defining a lacing opening for the upper; and a lateral reinforcing member extending upwardly on the lateral side of the shoe from between the sole and the upper to the forward portion of the lacing opening and secured to the lacing margin, said reinforcing member being positioned rearwardly of the flexing line of the shoe and comprising a thin, nonstretchable material with an interior region having a plurality of regularly spaced openings and solid edge regions for stitching;

whereby said reinforcing member reinforces the upper and laterally stabilizes the foot of the wearer while providing the shoe with breathability and flexibility.

8. An athletic shoe having a lateral side and a medial side, said shoe comprising:

an upper;

a sole secured to said upper;

a margin secured to said upper and defining an opening for said upper;

a lateral reinforcing member secured between said upper and said sole extending upwardly therefrom on the lateral side of the shoe to a forward portion of said opening and secured to said margin, said lateral reinforcing member disposed rearwardly of a line between the first metatarsal head and the fifth metatarsal head of a foot; and a medial reinforcing member secured between said upper and said sole extending upwardly therefrom on the medial side of the shoe to the forward portion of said opening and secured to said margin, said medial reinforcing member disposed rearwardly of a line between the first metatarsal head and the fifth metatarsal head of a foot;

each of said reinforcing members comprising an interior region having a plurality of regularly spaced openings and a solid edge region;

whereby said lateral reinforcing member and said medial reinforcing member reinforce said upper and laterally stabilize the foot of the wearer.

9. A shoe according to claim 8, wherein said interior region of said reinforcing members is mesh.

10. A shoe according to claim 8, wherein said reinforcing members are secured to said upper.

11. An athletic shoe having a lateral side and a medial side, said shoe comprising:

an upper;

a sole secured to said upper;

a margin secured to said upper and defining an opening for said upper;

a lateral reinforcing member secured between said upper and said sole extending upwardly therefrom on the lateral side of the shoe to a forward portion of said opening and secured to said margin, said lateral reinforcing member disposed rearwardly of a line between the first metatarsal head and the fifth metatarsal head of a foot;

a medial reinforcing member secured between said upper and said sole extending upwardly therefrom on the medial side of the shoe to the forward portion of said opening and secured to said margin, said medial reinforcing member disposed rearwardly of a line between the first metatarsal head and the fifth metatarsal head of a foot; and lacing holes disposed on each side of said opening in said margin and a lace, said reinforcing members each extending across at least one of said lacing holes and having a hole aligned therewith whereby said reinforcing members are drawn together and tightened by said lace;

whereby said lateral reinforcing members and said medial reinforcing member reinforce said upper and laterally stabilize the foot of the wearer.

12. An athletic shoe having a lateral side and a medial side, said shoe comprising:

an upper;

a sole secured to said upper;

a margin secured to said upper and defining an opening for said upper;

a lateral reinforcing member secured between said upper and said sole extending upwardly therefrom on the lateral side of the shoe to a forward portion of said opening and secured to said margin, said lateral reinforcing member disposed rearwardly of a line between the first metatarsal head and the fifth metatarsal head of a foot;

a medial reinforcing member secured between said upper and said sole extending upwardly therefrom on the medial side of the shoe to the forward portion of said opening and secured to said margin, said medial reinforcing member disposed rearwardly of a line between the first metatarsal head and the fifth metatarsal head of a foot; and a cross member extending between and joining said lateral reinforcing member and said medial reinforcing member forward of said opening, said cross member disposed rearwardly of a line between the first metatarsal head and the fifth metatarsal head of a foot;

whereby said lateral reinforcing member and said medial reinforcing member reinforce said upper and laterally stabilize the foot of the wearer.

13. A shoe according to claim 12, wherein said lateral reinforcing member, said medial reinforcing member and said cross member are integral.

14. An athletic shoe having a lateral side and a medial side, said shoe comprising:

an upper;

a sole secured to said upper;

a margin secured to said upper and defining an opening for said upper; and a lateral reinforcing member secured between said upper and said sole extending upward therefrom on the lateral side of the shoe to the forward portion of said opening and secured to said margin, said lateral reinforcing member disposed rearwardly of a line between the first metatarsal head and the fifth metatarsal head of a foot, and said lateral reinforcing member having an interior region having a plurality of regularly spaced openings and a solid edge region;

whereby said lateral reinforcing member reinforces said upper and laterally stabilizes the foot of the wearer.

15. A shoe according to claim 14, wherein said interior region of said lateral reinforcing member is mesh.

16. A shoe according to claim 14, wherein said lateral reinforcing member is secured to said upper.

17. A shoe according to claim 14, further comprising lacing holes disposed on each side of said opening in said margin and a lace, wherein said lateral reinforcing member extends across at least one of said lacing holes and has a hole aligned therewith whereby said lateral reinforcing member is drawn tight by said lace.

* * * * *